US008019298B2

(12) United States Patent
Reynolds et al.

(10) Patent No.: US 8,019,298 B2
(45) **Date of Patent: *Sep. 13, 2011**

(54) SATELLITE RADIO SYSTEM AND METHOD OF ACTIVATING SAME

(75) Inventors: Lisa Reynolds, Northville, MI (US); Francis Luk, Ann Arbor, MI (US); Mounir Hider, Dearborn Heights, MI (US); Sukhwinder Wadhwa, Windsor (CA)

(73) Assignee: Ford Motor Company, Dearborn, MI (US)

( * ) Notice: Subject to any disclaimer, the term of this patent is extended or adjusted under 35 U.S.C. 154(b) by 10 days.

This patent is subject to a terminal disclaimer.

(21) Appl. No.: 12/569,410

(22) Filed: Sep. 29, 2009

(65) Prior Publication Data

US 2010/0022182 A1 Jan. 28, 2010

Related U.S. Application Data

(63) Continuation of application No. 11/426,079, filed on Jun. 23, 2006, now Pat. No. 7,613,435.

(51) Int. Cl.
*H04H 1/00* (2006.01)

(52) U.S. Cl. ..... 455/152.1; 455/3.02; 455/3.06; 455/345

(58) Field of Classification Search ..... 455/1, 410, 455/411, 422.1, 435.2, 525, 456.1, 404.1, 455/114.1, 456.2, 404.2, 414.1, 420, 41.2, 455/552.1, 63.1, 3.02, 12.1, 419, 405, 427, 455/414.3, 412.1, 412.2, 406, 152.1, 161.1, 455/185.1, 186.1, 161.3, 3.04, 3.06; 370/252, 370/338, 328, 310.2, 331, 312; 342/13, 14, 342/15, 52, 54; 705/17, 44; 701/1, 36
See application file for complete search history.

(56) References Cited

U.S. PATENT DOCUMENTS

| | | | | |
|---|---|---|---|---|
| 6,128,482 | A | 10/2000 | Nixon et al. | |
| 6,462,665 | B1 | 10/2002 | Tarlton et al. | |
| 6,490,513 | B1 * | 12/2002 | Fish et al. | 701/35 |
| 2003/0012152 | A1 | 1/2003 | Feldman et al. | |
| 2003/0207682 | A1 * | 11/2003 | Videtich | 455/410 |
| 2004/0023647 | A1 * | 2/2004 | Mazzara et al. | 455/419 |
| 2004/0054443 | A1 | 3/2004 | Hall et al. | |
| 2004/0259524 | A1 * | 12/2004 | Watkins et al. | 455/405 |
| 2005/0098510 | A1 | 5/2005 | Lom et al. | |
| 2005/0107035 | A1 * | 5/2005 | Zoeckler | 455/12.1 |
| 2005/0130585 | A1 | 6/2005 | Gnuschke et al. | |
| 2005/0215194 | A1 | 9/2005 | Boling et al. | |
| 2005/0239450 | A1 | 10/2005 | Wesby | |
| 2005/0283284 | A1 * | 12/2005 | Grenier et al. | 701/29 |
| 2006/0217109 | A1 * | 9/2006 | Sobb et al. | 455/414.1 |
| 2006/0240811 | A1 * | 10/2006 | De Luca | 455/414.3 |

FOREIGN PATENT DOCUMENTS

| | | |
|---|---|---|
| JP | 2002304376 | 10/2002 |
| WO | 2005022935 A2 | 3/2005 |

* cited by examiner

*Primary Examiner* — Tan Trinh
(74) *Attorney, Agent, or Firm* — Damian Porcari; Brooks Kushman P.C.

(57) ABSTRACT

A satellite radio system may include at least one computing device configured to receive a transaction date associated with a vehicle, to determine a preactivation duration based on the date, and to determine whether the preactivation duration exceeds a predetermined time period. The at least one computing device may be further configured to initiate the transmission of deactivation information for a satellite radio module in the vehicle if the preactivation duration exceeds the predetermined time period to disable the module from playing satellite broadcast signals.

6 Claims, 3 Drawing Sheets

SATELLITE RADIO SYSTEM AND METHOD OF ACTIVATING SAME

CROSS-REFERENCE TO RELATED APPLICATION

This application is a continuation of application Ser. No. 11/426,079, filed Jun. 23, 2006, which is hereby incorporated by reference in its entirety.

BACKGROUND

Once a customer purchases a vehicle with a satellite radio, the customer may activate the satellite radio by tuning the satellite radio to an activation channel for a period of time. A satellite radio service provider broadcasts a satellite radio activation signal at predetermined intervals.

Once a customer purchases a vehicle with a satellite radio, the customer may activate the satellite radio by informing a satellite radio service provider of the satellite radio's identification number while the satellite radio is on. The satellite radio service provider then broadcasts a satellite radio activation signal to activate the satellite radio.

The above methods may inconvenience a customer because of the time associated with activating the satellite radio module. Also, the customer may not be able to fully evaluate satellite radio service when they are deciding to purchase a vehicle because the satellite radio may have limited or no functionality.

A manufacturer or dealer may activate a vehicle's satellite radio before the customer purchases the vehicle by the above methods. The manufacturer or dealer, however, is similarly inconvenienced because of the time associated with activating the satellite radio.

A manufacturer may activate a satellite radio by connecting it to a fixture that will download firmware to the satellite radio. The firmware may allow the satellite radio to play a preview channel broadcast by a satellite radio service provider for a predetermined period of time less than the useful life of the vehicle. Once the period of time expires, the firmware disables the satellite radio from playing the preview channel. In order to extend service beyond the period of time, a customer, dealer, or manufacturer may need to contact the satellite radio service provider and perform one of the methods discussed above.

SUMMARY

A satellite radio system may include at least one computing device configured to receive a transaction date associated with a vehicle, to determine a preactivation duration based on the date, and to determine whether the preactivation duration exceeds a predetermined time period. The at least one computing device may be further configured to initiate the transmission of deactivation information for a satellite radio module in the vehicle if the preactivation duration exceeds the predetermined time period to disable the module from playing satellite broadcast signals.

A satellite radio activation system may include an activation circuit arranged to establish communications with a satellite radio module of a vehicle, to transfer a serial number to the module, to enable the module to play a set of satellite radio channels for a time period approximately equal to the vehicle's useful life, and to configure the module to deactivate if the module receives deactivation information including the serial number from a satellite broadcast.

A method for activating a satellite radio module of a vehicle may include establishing communications with the module, transferring a serial number to the module, enabling the module to play a set of satellite radio channels for the vehicle's useful life, and configuring the module to deactivate if the module receives deactivation information including the serial number from a satellite broadcast.

While exemplary embodiments in accordance with the invention are illustrated and disclosed, such disclosure should not be construed to limit the claims. It is anticipated that various modifications and alternative designs may be made without departing from the scope of the invention.

DETAILED DESCRIPTION

Figure 1:
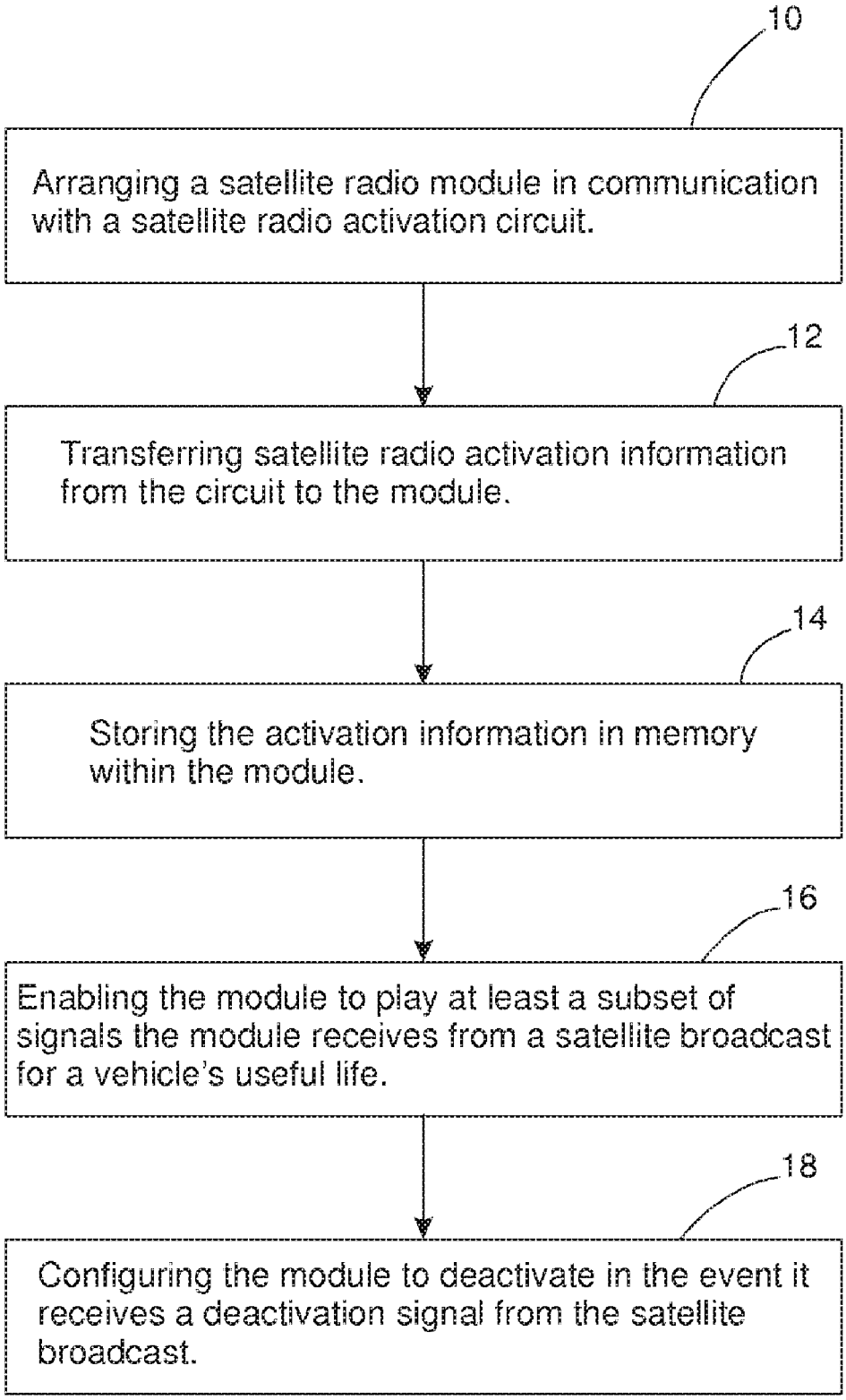
FIG. 1 shows a flow chart of a method of the present invention.

A down link processor (DLP), is communicably connected with an activation fixture. For example, the DLP may communicate with the activation fixture via a pin to pad connection. A DLP outfitted with a wireless receiver, for example, may communicate with an activation fixture outfitted with a wireless transmitter using a wireless protocol, e.g., 802.11. Any desired communication connection, e.g., infrared, between the DLP and the activation fixture may be used.

A microprocessor of the DLP receives information, e.g., firmware, transmitted by the activation fixture. The information is stored on the microprocessor's on-chip memory. The information, however, may be stored in any desired fashion.

The information determines which satellite radio channels will be active and which satellite radio channels will not be active. The DLP's active channels will remain active until the DLP receives a deactivation signal via a satellite broadcast.

The information also includes a unique identifier, e.g., an electronic serial number (ESN). The ESN is used to identify the module. The ESN may also be placed on the module, e.g., in bar code format, so that the ESN can be ascertained by inspection.

The DLP is then connected with a vehicle's communication system, power, and audio outputs via a 12-way connector; the DLP is connected with the vehicle's satellite radio antenna via a coaxial connection. The DLP, however, may be connected with the vehicle in any desired fashion.

The ESN and a vehicle identification number (VIN) associated with the vehicle are linked by, for example, querying the DLP for its ESN during an electrical check of the vehicle's electrical system or scanning a bar code on the DLP containing the ESN information. The VIN is already known while this querying or scanning operation takes place because the VIN is tracked throughout the vehicle assembly process. If the VIN is not known, the VIN information can be ascertained in any desired manner.

A file containing the VIN and ESN information is created and stored in a database along with the date the file containing the VIN and ESN information was created.

A satellite radio service provider is informed about the VIN and ESN information. For example, a signal is transmitted to the satellite radio service provider via the internet containing the VIN and ESN information along with the date the file containing the VIN and ESN information was created.

The satellite radio service provider tracks the VIN and ESN information. For example, the satellite radio service provider will track the VIN and ESN information for a period of six months. The six-month time period begins on the date the file containing the VIN and ESN information was created. If the satellite radio service provider is not informed that the vehicle was shipped from its manufacturing facility to a vehicle dealer within the six-month period of time, the satellite radio service provider will broadcast a deactivation signal for the DLP after the expiration of the six-month period of time.

When the vehicle leaves its manufacturing facility and is delivered to a vehicle dealer, information about the vehicle is gathered and stored. For example, information about the date on which the vehicle is shipped from its manufacturing facility to a dealer is associated with its VIN, e.g., scanned, and stored in a database.

The satellite radio service provider is informed about the shipping date information. For example, a signal is transmitted to the satellite radio service provider via the internet containing the shipping date information including the vehicle's VIN.

The satellite radio service provider tracks the shipping date information. For example, the satellite radio service provider will track the shipping date information for a period of fifteen months. The fifteen-month time period begins on the date the vehicle was shipped from its manufacturing facility to the dealer. If the satellite radio service provider is not informed that the vehicle was sold to a customer within the fifteen-month period of time, the satellite radio service provider will broadcast a deactivation signal for the DLP after the expiration of the fifteen-month period of time.

When the vehicle is sold to a customer, information about the sale is gathered, transmitted, and stored. For example, information about the date on which the vehicle is sold to a customer is associated with its VIN, e.g., input by the vehicle dealer, and stored in a database. The sale date information is transmitted to the vehicle's manufacturer via the internet. The vehicle's manufacturer stores the sale date information in a database.

The satellite radio service provider is informed about the sale date information. For example, a signal is transmitted to the satellite radio service provider via the internet containing the sale date information including the vehicle's VIN.

The satellite radio service provider tracks the sale date information. For example, the satellite radio service provider will track the sale date information for a period of six months. The six-month time period begins on the date the vehicle was sold to the customer. If the satellite radio service provider is not informed that the customer wishes to extend their service within the six-month period of time, the satellite radio service provider will broadcast a deactivation signal for the DLP after the expiration of the six-month period of time.

FIG. 1 shows a flow chart of a method of the present invention.

At step 10, a satellite radio module is arranged in communication with a satellite radio activation circuit. The module may be arranged in communication with the circuit via a physical data link or a wireless data link.

At step 12, satellite radio activation information is transferred from the circuit to the module. The activation information may include a module identification number.

At step 14, the satellite radio activation information is stored in memory within the module.

At step 16, the module is enabled to play at least a subset of signals the module receives from a satellite broadcast for the vehicle's useful life. The subset is defined by the activation information.

At step 18, the module is configured to deactivate in the event it receives a deactivation signal from the satellite broadcast.

Figure 2:
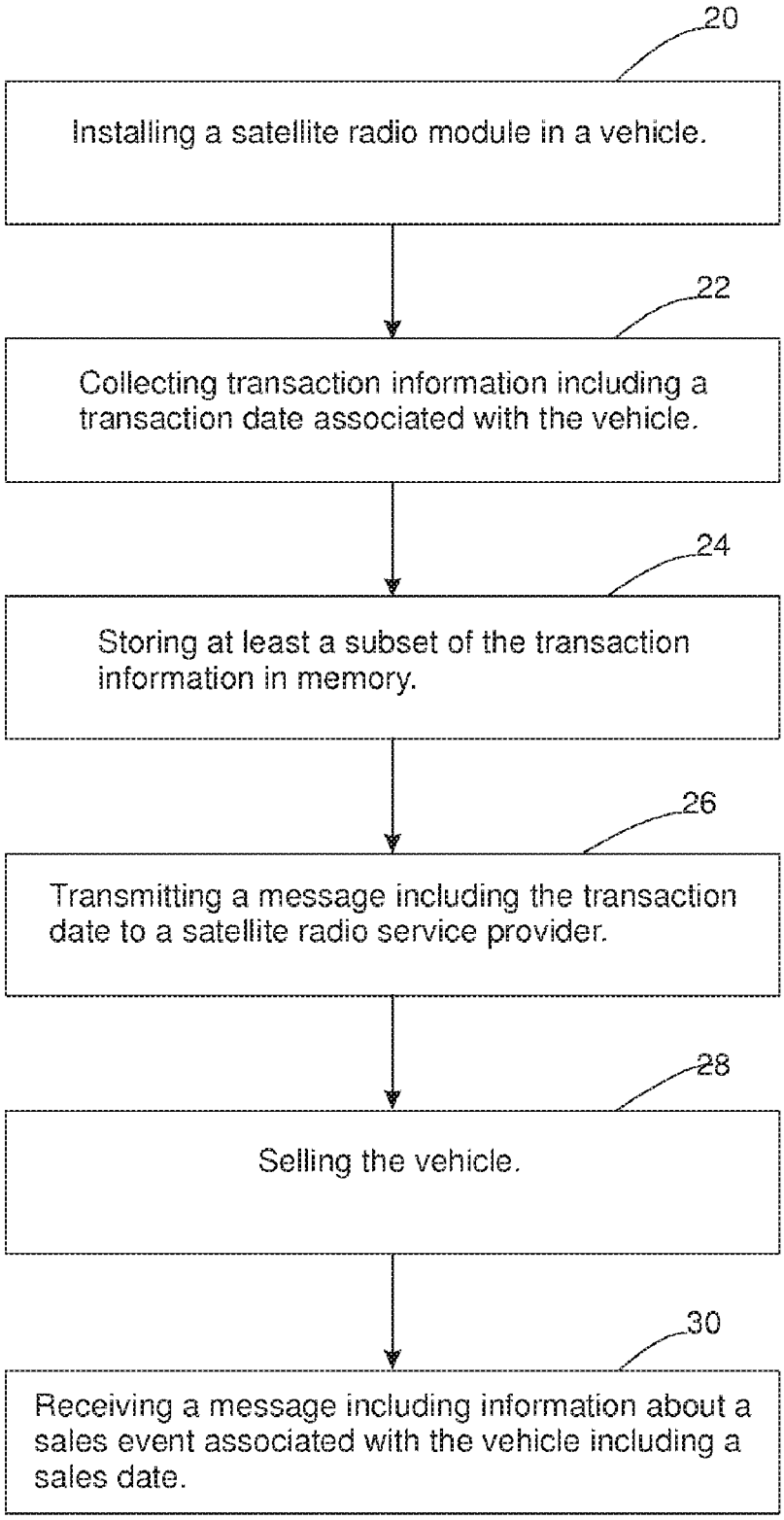
FIG. 2 shows a flow chart of a method of the present invention.

FIG. 2 shows a flow chart of a method of the present invention.

At step 20, a satellite radio module is installed in a vehicle. The module may include a module identification number. The vehicle may include a vehicle identification number. The module is enabled to play at least a subset of signals the module receives from a satellite broadcast for the vehicle's useful life. The subset is defined by activation information. The module is configured to deactivate in the event the module receives a deactivation signal from the satellite broadcast.

At step 22, transaction information including a transaction date associated with the vehicle is collected. The transaction information may include the module identification number. The transaction information may include the vehicle identification number. The transaction date may be a module installation date. The transaction date may be a shipping date. The transaction date may be a sales date.

At step 24, at least a subset of the transaction information is stored in memory.

At step 26, a message including the transaction date is transmitted to a satellite radio service provider such that a determination can be made regarding a preactivation duration.

At step 28, the vehicle is sold.

At step 30, a message including information about a sales event associated with the vehicle including a sales date is received.

Figure 3:
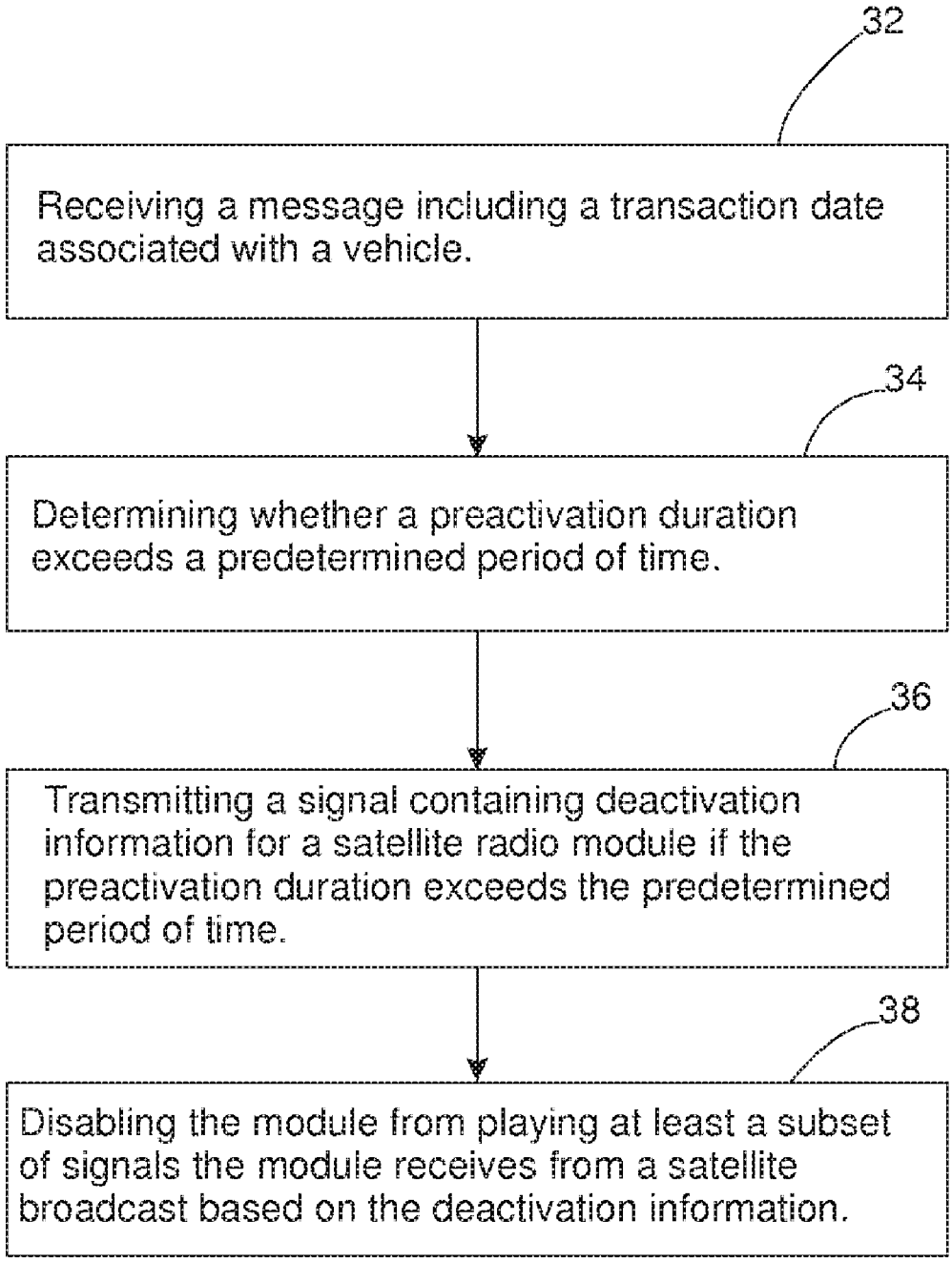
FIG. 3 shows a flow chart of a method of the present invention.

FIG. 3 shows a flowchart of a method of the present invention.

At step 32, a message including a transaction date associated with a vehicle is received. The message may come from a manufacturer. The message may include a module identification number for a satellite radio module installed in the vehicle or the vehicle's identification number. The transaction date is used to determine a preactivation duration. The transaction date may indicate the date on which the module was installed in the vehicle. The transaction date may indicate a date on which the vehicle was shipped. The transaction date may indicate a date on which the vehicle was sold. The preactivation duration may begin after the module is installed in the vehicle. The preactivation duration may begin after the vehicle is shipped. The preactivation duration may begin after the vehicle is sold.

At step 34, a determination is made as to whether the preactivation duration exceeds a predetermined period of time.

At step 36, a signal containing deactivation information for the module is transmitted if the preactivation duration exceeds the predetermined period of time.

At step 38, the module is disabled from playing at least a subset of signals the module receives from a satellite broadcast based on the deactivation information.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed:

1. A satellite radio system comprising:

at least one computing device configured to (i) receive a transaction date associated with a vehicle, (ii) determine a preactivation duration based on the date, (iii) determine whether the preactivation duration exceeds a predetermined time period, and (iv) initiate the transmission of deactivation information for a satellite radio module in the vehicle if the preactivation duration exceeds the predetermined time period to disable the module from playing satellite broadcast signals.

2. The system of claim 1 wherein the at least one computing device is further configured to receive an identification number of the satellite radio module in the vehicle and wherein the deactivation information includes the identification number.

3. The system of claim 1 wherein the at least one computing device is further configured to receive an identification number of the vehicle and wherein the deactivation information includes the identification number.

4. The system of claim 1 wherein the transaction date is a date on which the satellite radio module was installed in the vehicle.

5. The system of claim 1 wherein the transaction date is a date on which the vehicle was shipped from a manufacturing facility.

6. The system of claim 1 wherein the transaction date is a date on which the vehicle was sold to a customer.

* * * * *